US009173019B2

(12) United States Patent
Chen

(10) Patent No.: US 9,173,019 B2
(45) Date of Patent: Oct. 27, 2015

(54) LOUDSPEAKER WITH ROTATABLE SOUND-REFLECTING MEMBER

(71) Applicant: HON HAI PRECISION INDUSTRY CO., LTD., New Taipei (TW)

(72) Inventor: Chih-Hua Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 152 days.

(21) Appl. No.: 14/093,064

(22) Filed: Nov. 29, 2013

(65) Prior Publication Data

US 2015/0139454 A1 May 21, 2015

(30) Foreign Application Priority Data

Nov. 19, 2013 (TW) ..... 102142063 A

(51) Int. Cl.

| | |
|---|---|
| ***H04R 25/00*** | (2006.01) |
| ***H04R 1/02*** | (2006.01) |
| ***H04R 9/06*** | (2006.01) |
| ***H04R 1/34*** | (2006.01) |
| ***H04R 1/28*** | (2006.01) |

(52) U.S. Cl.

CPC ..... *H04R 1/345* (2013.01); *H04R 1/02* (2013.01); *H04R 1/025* (2013.01); *H04R 1/026* (2013.01); *H04R 1/28* (2013.01); *H04R 9/06* (2013.01); *H04R 2201/025* (2013.01)

(58) Field of Classification Search

CPC ..... H04R 1/02; H04R 9/06; H04R 1/025; H04R 1/026; H04R 1/345; H04R 2201/025; H04R 1/28

USPC ..... 381/87, 160, 332, 334, 336, 386, 387, 381/390, 395; 181/150, 155, 156, 199; 248/176.1, 177.1, 222.52, 288.11

See application file for complete search history.

(56) References Cited

U.S. PATENT DOCUMENTS

| | | | | |
|---|---|---|---|---|
| 3,454,729 | A * | 7/1969 | Seebinger | 381/341 |
| 8,559,666 | B2 * | 10/2013 | Shibata | 381/395 |
| 2014/0072160 | A1 * | 3/2014 | Peacock | 381/336 |

* cited by examiner

*Primary Examiner* — Matthew Eason

*Assistant Examiner* — Sean H Nguyen

(74) *Attorney, Agent, or Firm* — Novak Druce Connolly Bove + Quigg LLP

(57) ABSTRACT

A loudspeaker includes a circuit board, a base mounted on a rear side of the circuit board, a positioning apparatus slidably installed between the base and the circuit board, a sound-reflecting member positioned at a front side of the circuit board, a connecting member connected between the base and the sound-reflecting member, a sound generator, and a controller. The sound-reflecting member includes a sound-reflecting plate and a number of magnetic pieces around the sound-reflecting plate. Many first electromagnets are mounted on the front side of the circuit board, aligning with the magnetic pieces. The position apparatus includes a positioning bracket. The connecting member includes a rotating portion rotatably connected to the base. A second electromagnet is mounted to the circuit board, to move the positioning bracket. The controller controls one or more of the first electromagnets to attract the corresponding magnetic pieces, to allow the sound-reflecting member to swing.

17 Claims, 7 Drawing Sheets

LOUDSPEAKER WITH ROTATABLE SOUND-REFLECTING MEMBER

BACKGROUND

1. Technical Field

The present disclosure generally relates to loudspeakers.

2. Description of Related Art

Sound broadcasted by loudspeakers travels in all directions. However, the sound may not be heard equally clearly by people at different locations. Therefore, there is room for improvement in the art.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references can mean "at least one."

Figure 1:
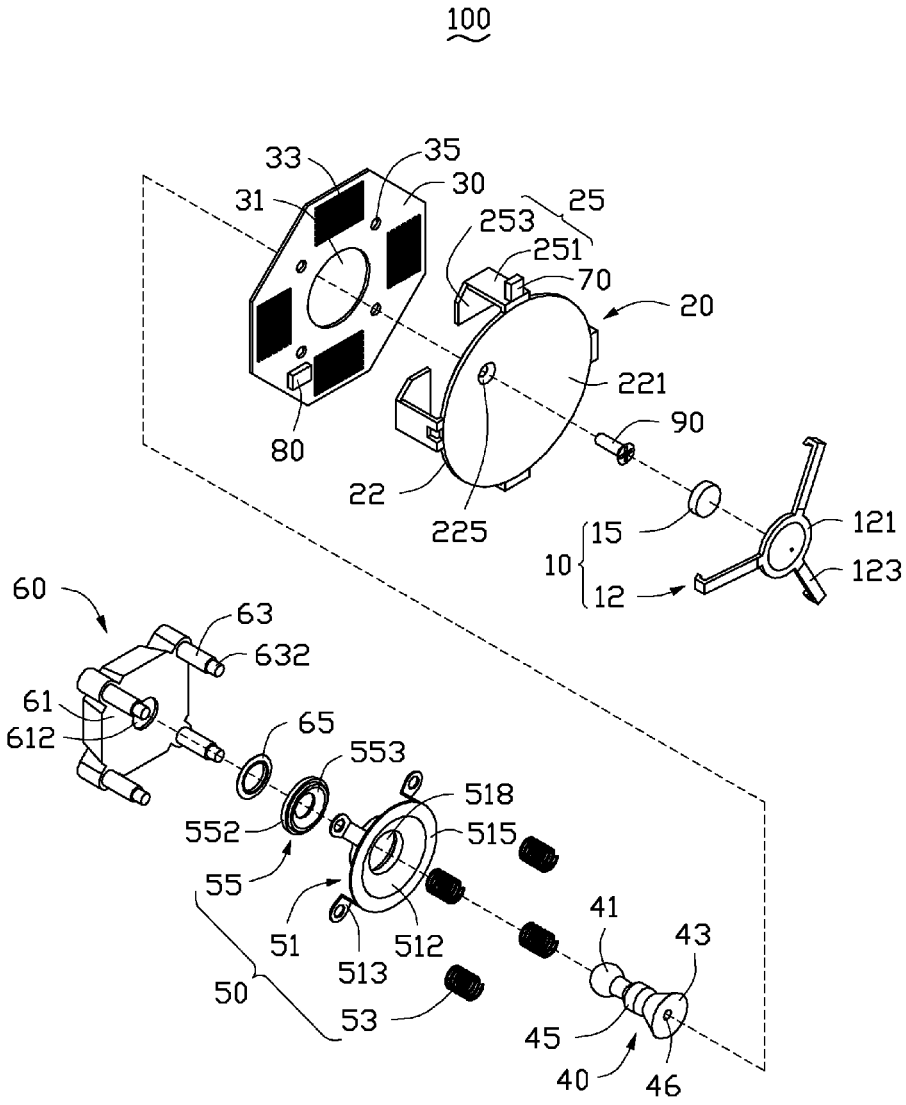
FIG. 1 is an exploded, isometric view of an embodiment of a loudspeaker.
Figure 2:
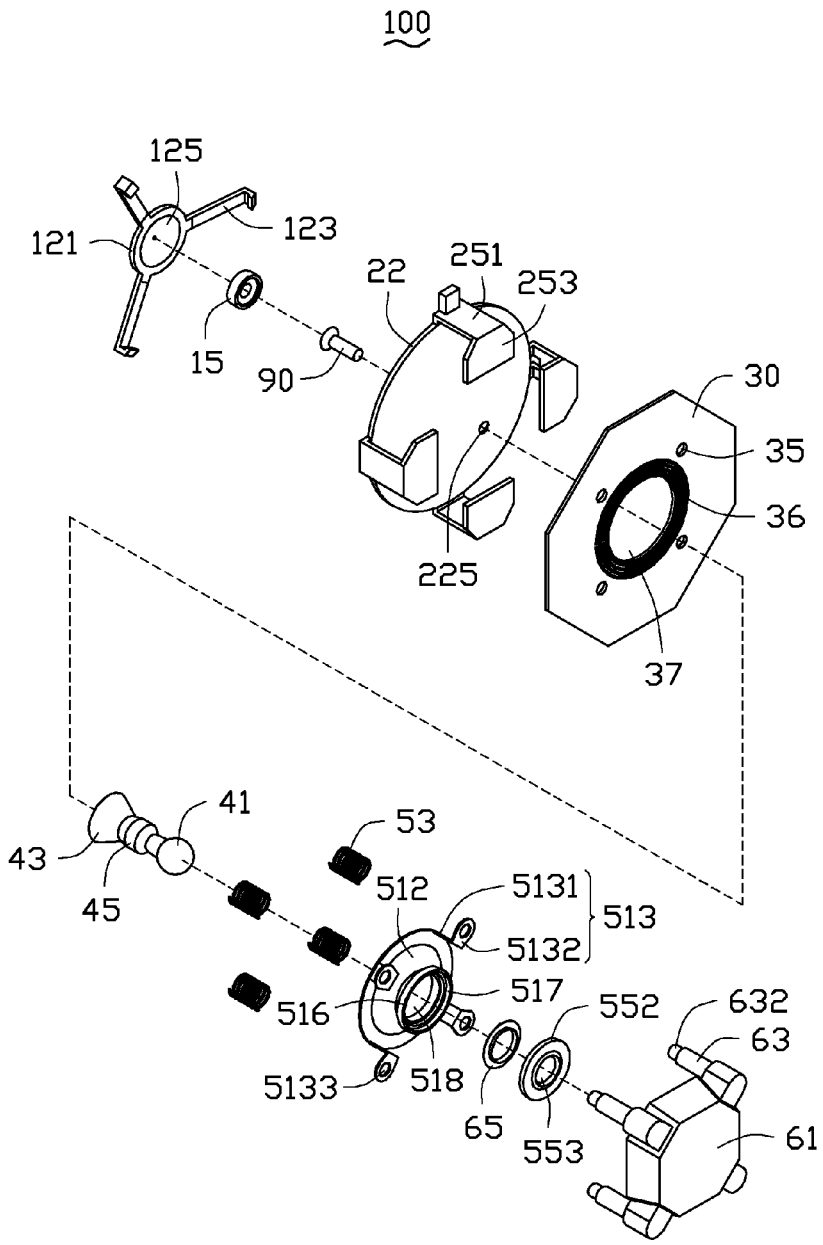
FIG. 2 is similar to FIG. 1, but viewed from another perspective.

FIGS. 1 and 2 show an embodiment of a loudspeaker 100. The loudspeaker 100 includes a sound generator 10, a sound-reflecting member 20, a circuit board 30, a connecting member 40, a positioning apparatus 50, a base 60, a monitoring apparatus 70, a controller 80, and a fastening member 90.

The sound generator 10 includes a mounting bracket 12 and an electromagnetic actuator 15. The mounting bracket 12 includes a bowl 121, and a plurality of connecting hooks 123 extending out from a circumference of the bowl 121. An inner surface of the bowl 121 defines a latching hole 125 for receiving the electromagnetic actuator 15. The electromagnetic actuator 15 is configured for generating sound.

The sound-reflecting member 20 includes a bowl-shaped sound-reflecting plate 22, and a plurality of magnetic pieces 25 extending from a circumference of the sound-reflecting plate 22. The sound-reflecting plate 22 is made of acoustic resistant material. An inner surface of the sound-reflecting plate 22 is a bowl-shaped sound-reflecting surface 221. An area of the sound-reflecting surface 221 is greater than an area of an outer surface of the electromagnetic actuator 15 opposite to the sound-reflecting surface 21. A through hole 225 is axially defined in the sound-reflecting plate 22. Each magnetic piece 25 includes an extending portion 251 extending rearward from the circumference of the sound-reflecting plate 22, and a magnetic portion 253 extending in from a distal end of the extending portion 251 toward an axis (not labeled) defined by the through hole 225 of the sound-reflecting plate 22. In the embodiment, each magnetic portion 253 is made of iron.

The circuit board 30 defines a receiving hole 31. Four first electromagnets 33 are mounted on a front surface of the circuit board 30. A ring-shaped second electromagnet 36 is mounted on a rear surface of the circuit board 30, and positioned adjacent a sidewall bounding the receiving hole 31. The circuit board 30 defines four mounting holes 35 around the receiving hole 31.

The connecting member 40 includes a spherical rotating portion 41, a mounting portion 43 opposite to the rotating portion 41, and a connecting pole 45 connected between the rotating portion 41 and the mounting portion 43. A middle of the mounting portion 43 defines an installing hole 46 extending along an axial direction of the connecting pole 45.

The positioning apparatus 50 includes a positioning bracket 51, four resilient members 53, and a positioning ring 55. The positioning bracket 51 includes a shell 512, and four L-shaped connection plates 513 extending rearward from a circumference of the shell 512. The shell 512 includes a ring-shaped magnetic plate 515, and an installation plate 516 extending rearward from an inner side of the magnetic plate 515. The installation plate 516 bounds a through hole 518 extending through the magnetic plate 515. In the embodiment, the magnetic plate 515 is made of iron, and each resilient member 53 is a spring. The installation plate 516 includes a positioning portion 517 away from the magnetic plate 515, for installing the positioning ring 55 therein. Each connection plate 513 includes an extending portion 5131 extending rearward from the magnetic plate 515, and a guiding portion 5132 extending out from a distal end of the extending portion 5131 away from the installation plate 516. Each guiding portion 5132 defines a guiding hole 5133.

The positioning ring 55 is made of pliable material, such as pliable plastic. The positioning ring 55 includes a ring-shaped latching portion 552 positioned on an outer side of the positioning ring 55, and a ring-shaped engaging portion 553 positioned on an inner side of the positioning ring 55.

The base 60 includes a rectangular plate 61, four guiding poles 63 extending forward from four corners of the plate 61, and a resilient installation ring 65. A middle of a front surface of the plate 61 defines a rotation hole 612. A latching pin 632 extends forward from a distal end of each guiding pole 63.

The monitoring apparatus 70 is mounted to one of the extending portions 251, and the monitoring apparatus 70 faces the sound generator 10. The monitoring apparatus 70 and the sound-reflecting member 20 face a same direction. The monitoring apparatus 70 is configured for capturing images in front of the sound-reflecting member 20.

The controller 80 is mounted on the circuit board 30, and is electrically coupled to the monitoring apparatus 70, the first electromagnets 33, and the second electromagnet 36.

Figure 3:
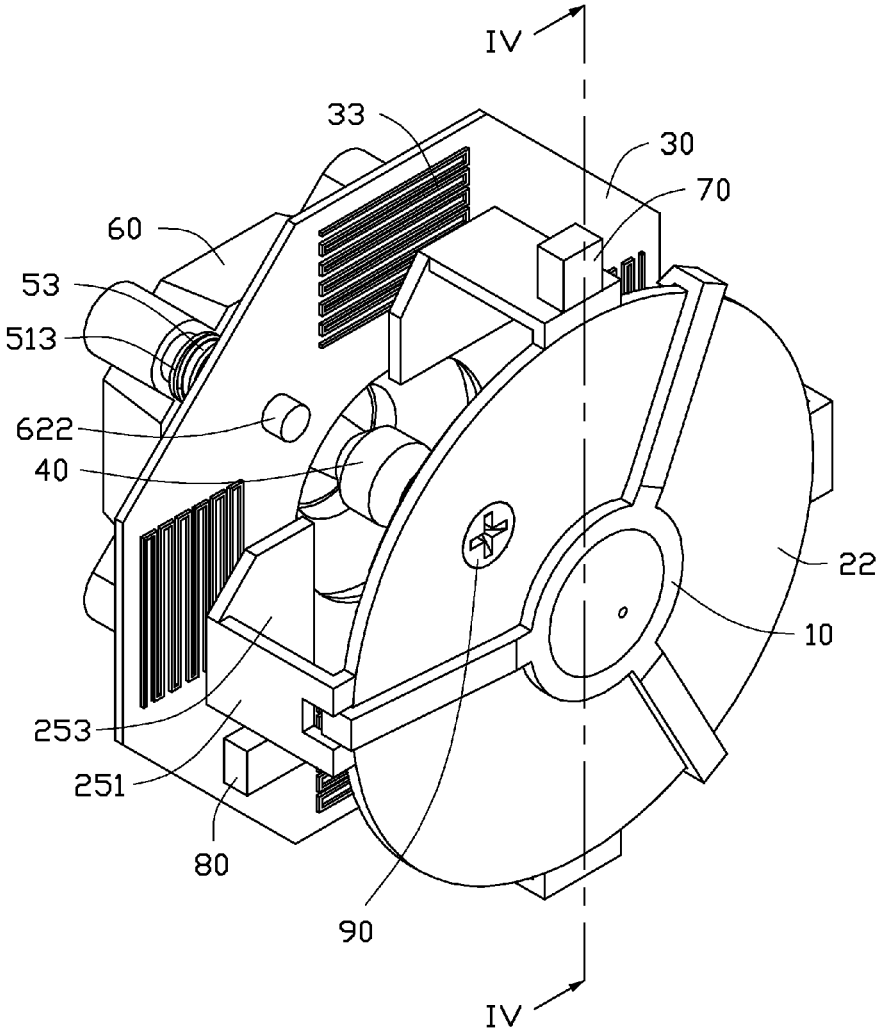
FIG. 3 is an enlarged, assembled view of the loudspeaker of FIG. 1.
Figure 4:
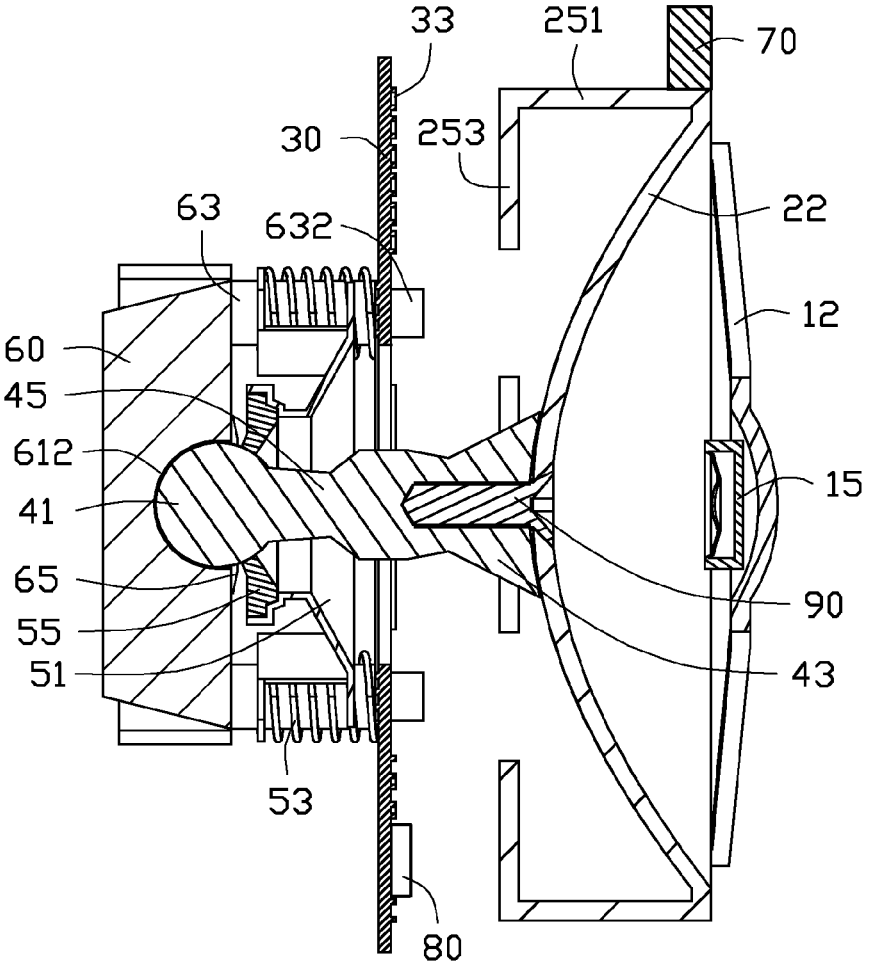
FIG. 4 is a cross-sectional view of FIG. 3, taken along line IV-IV thereof.

FIGS. 3 and 4 show that in assembly of the loudspeaker 100, the rotating portion 41 of the connecting member 40 is inserted into a through hole of the installation ring 65. The installation ring 65 elastically deforms, until the rotating portion 41 interferingly penetrates fully through the through hole of the installation ring 65. The installation ring 65 then elastically recovers to become engaged around the connecting member 40 forward of the rotating portion 41. The rotating portion 41 is rotatably received in the rotation hole 612. The installation ring 65 is latched in the rotation hole 612 for preventing the rotating portion 41 from detaching out from the rotation hole 61.

Then the latching portion 552 of the positioning ring 55 is received in the positioning portion 517 of the positioning bracket 51. The guiding poles 63 are inserted into the guiding holes 5133 of the positioning bracket 51 and the resilient members 53 in that order, to latch in the mounting holes 35 of the circuit board 30, from the rear sides of the positioning bracket 51 and the circuit board 30. The mounting portion 43 of the connecting member 40 extends through the positioning ring 55, the through hole 518 of the positioning bracket 51, and the receiving hole 31 of the circuit board 30. The mounting portion 43 is exposed through the front side of the circuit board 30. The resilient members 53 are fitted about the guiding poles 63 and resiliently sandwiched between the connection plates 513 of the positioning bracket 51 and the circuit board 30. The positioning bracket 51 is slidably fitted about the guiding poles 63 through the through holes 518. The resilient members 53 abut against the positioning bracket 51, to bias the positioning bracket 51 to slide away from the circuit board 30, thereby allowing the engaging portion 553 of the positioning ring 55 to engage with the rotating portion 41 to position the connecting member 40.

Then an outer surface of the sound-reflecting member 20 opposite to the sound-reflecting surface 221 is attached to the mounting portion 43, such that the through hole 225 is aligned with the installing hole 46 of the connecting member 40. The fastening member 90 extends through the through hole 225 and is screwed in the installing hole 46, to secure the sound-reflecting member 20 to the mounting portion 43 of the connecting member 40. Thus, the first electromagnets 35 align with the magnetic portions 253 of the sound-reflecting member 20, and the magnetic plate 515 of the positioning bracket 51 aligns with the second electromagnet 36. The electromagnetic actuator 15 is received in the latching hole 125 of the mounting bracket 12, such that the electromagnetic actuator 15 faces the sound-reflecting surface 221. The connecting hooks 123 are latched with the circumference of the sound-reflecting member 20.

Figure 5:
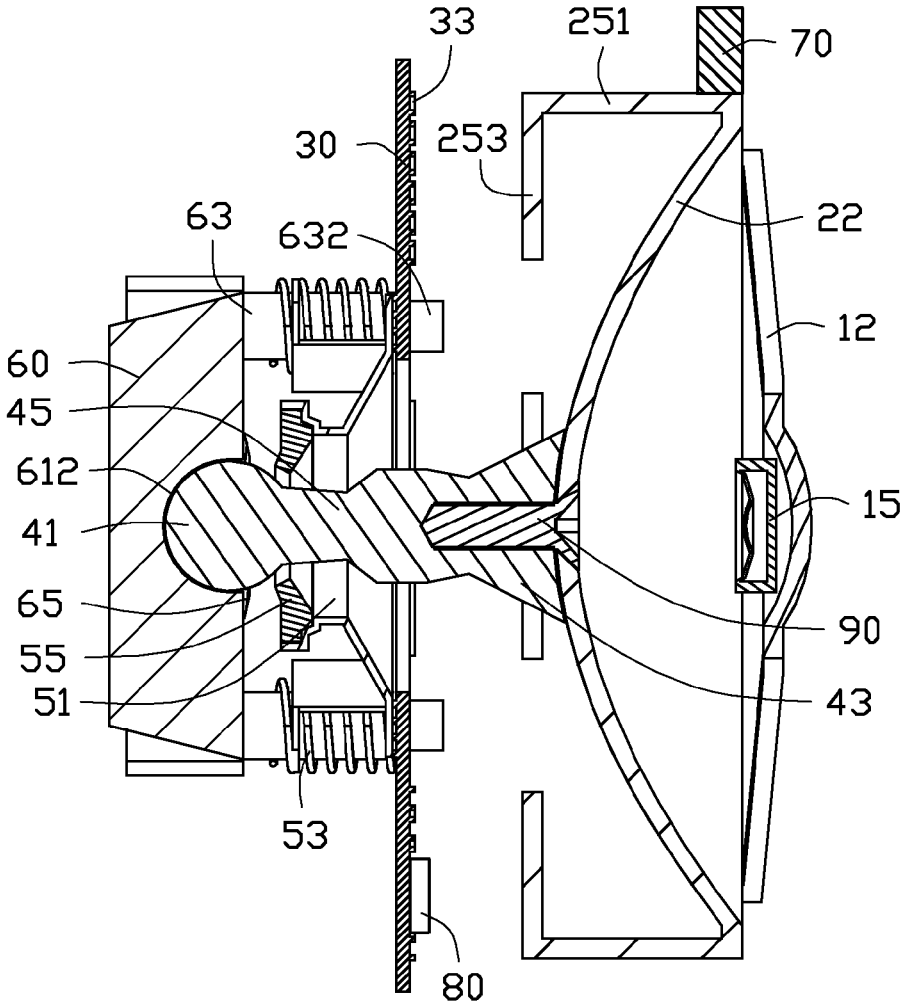
FIGS. 5-6 are similar to FIG. 4, but show successive stages in movement of certain parts of the loudspeaker when the loudspeaker is in use.
Figure 6:
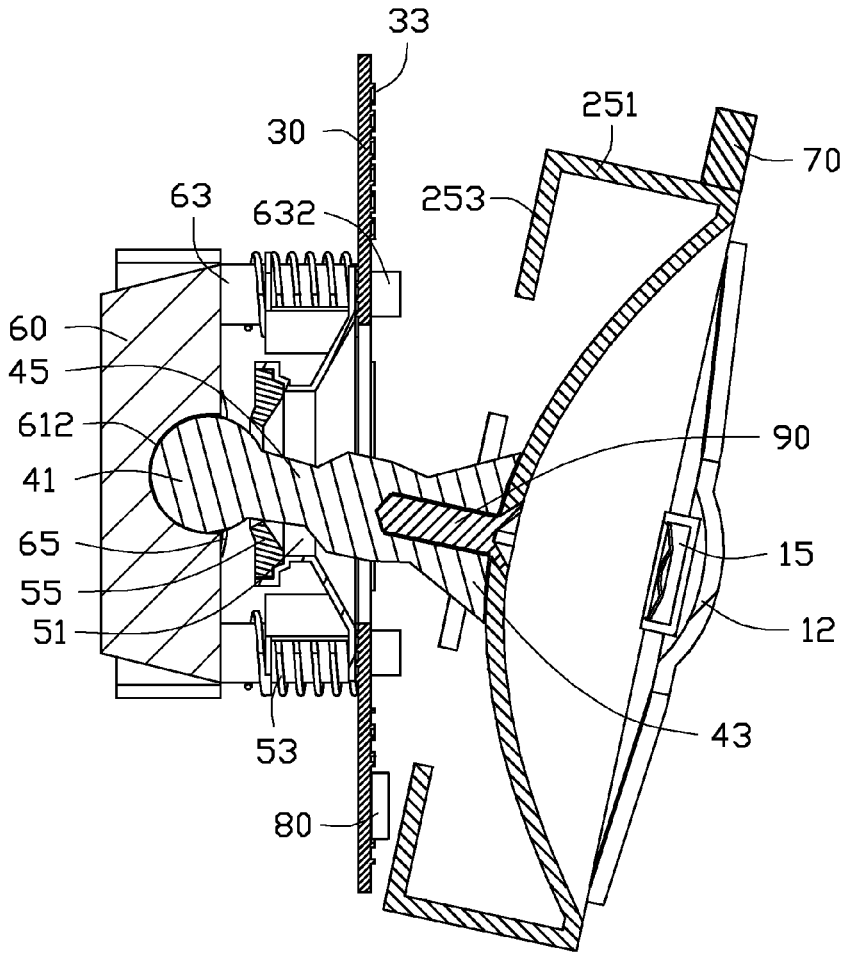
Figure 7:
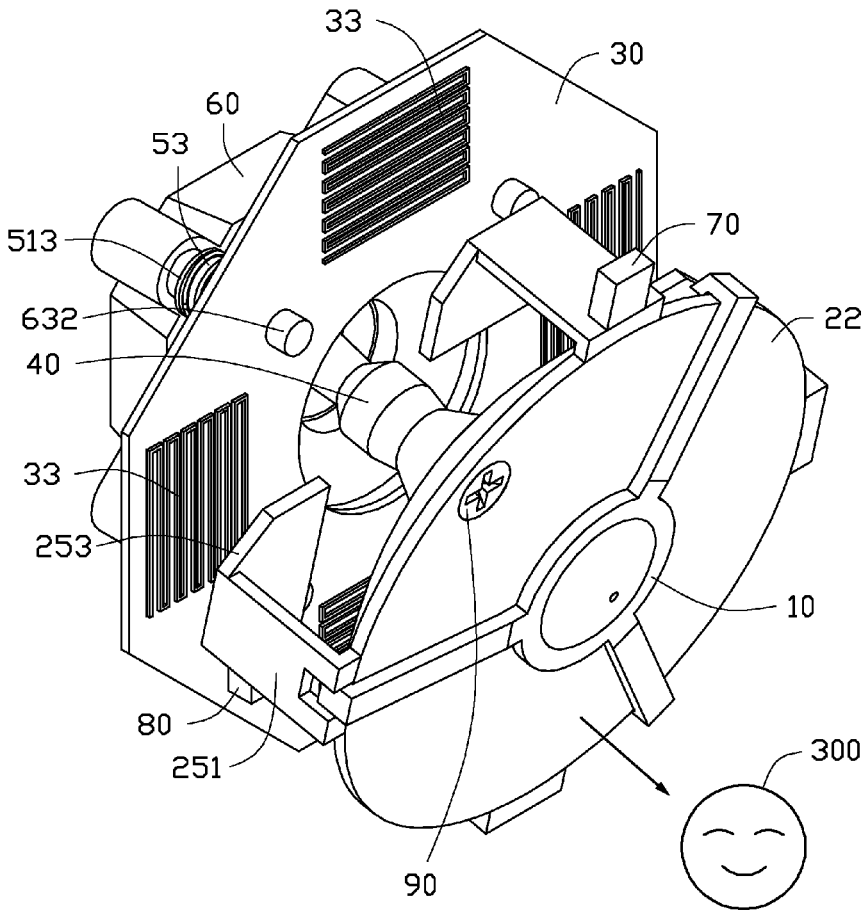
FIG. 7 is similar to FIG. 3, but shows certain parts of the loudspeaker having moved from an initial position to provide a user with good sound directionality.

FIGS. 5-7 show that in use, the sound generator 10 generates sound for a user 300. The monitoring apparatus 70 captures images of the user 300 and transmits the images to the controller 80. The controller 80 recognizes a human face from the images. The controller 80 controls the second electromagnet 36 to turn on. When the second electromagnet 36 is turned on, the magnetic plate 515 of the positioning bracket 51 is attracted to the second electromagnet 36, causing the positioning bracket 51 to slide about the guiding poles 63 away from the plate 61 and deform the resilient members 53. As a result, the engaging portion 553 of the positioning ring 55 is detached from the rotating portion 41. The controller 80 then controls one or more of the first electromagnets 33 to turn on, causing the corresponding one or more magnetic pieces 25 to be attracted to the one or more first electromagnets 33, which further causes the connecting member 40 to swing. The rotating portion 41 is rotated in the rotation hole 612, and the connecting member 40 swings the sound-reflecting member 20, such that the sound-reflecting member 20 points toward the user 300. Thereby, an angle of the sound-reflecting member 20 and the circuit board 30 is adjusted, and sound generated by the sound generator 10 is broadcasted toward the user 300.

The controller 80 controls the second electromagnet 36 to turn off, causing the resilient members 53 to be restored to bias the positioning bracket 51 to move back toward the plate 61 of the base 60. The magnetic plate 515 is detached from the second electromagnet 36, and the engaging portion 553 engages with the rotating portion 41 to securely hold the sound-reflecting member 20 in position.

It is to be understood that even though numerous characteristics and advantages of the embodiment have been set forth in the foregoing description, together with details of the structures and functions of the embodiment, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A loudspeaker, comprising:

a circuit board comprising a plurality of first electromagnets mounted on a front surface of the circuit board, and a second electromagnet mounted on a rear surface of the circuit board;

a base mounted at a rear side of the circuit board;

a positioning apparatus slidably installed between the circuit board and the base, and comprising a magnetic plate aligning with the second electromagnet, and a plurality of resilient members sandwiched between the positioning apparatus and the circuit board;

a sound-reflecting member positioned at a front side of the circuit board, and comprising a sound-reflecting plate and a plurality of magnetic pieces extending rearward from a circumference of the sound-reflecting plate and aligned with the first electromagnets;

a connecting member connected between the base and the sound-reflecting member, and comprising a rotating portion rotatably connected to the base;

a sound generator mounted to the sound-reflecting member; and a controller electrically coupled to the plurality of first electromagnets and the second electromagnet;

wherein the resilient members bias the positioning apparatus to engage with the rotating portion of the connecting member, the controller controls the second electromagnet to attract the magnetic plate, to allow the positioning apparatus to slide and detach from the rotating portion of the connecting member, and the controller controls one or more of the first electromagnets to attract the corresponding one or more magnetic pieces, to allow the sound-reflecting member and the connecting member to swing, and thereby to adjust an angle between the sound-reflecting member and the circuit board.

2. The loudspeaker of claim 1, wherein the circuit board defines a receiving hole, and the connecting member extends through the receiving hole of the circuit board and is connected between the base and the sound-reflecting member.

3. The loudspeaker of claim 2, wherein the second electromagnet is ring-shaped, and is positioned adjacent a sidewall bounding the receiving hole.

4. The loudspeaker of claim 1, wherein the base comprises a plate and a plurality of guiding poles extending forward from the plate, the plate defines a rotation hole, and the rotating portion of the connecting member is rotatably received in the rotation hole of the plate.

5. The loudspeaker of claim 4, wherein the circuit board defines a plurality of mounting holes, a plurality of latching pins extends forward from distal ends of the plurality of guiding poles, and the latching pins are latched in the mounting holes, respectively.

6. The loudspeaker of claim 4, wherein the base further comprises an installing ring latched in the rotation hole of the base, to prevent the rotating portion from detaching out from the rotation hole.

7. The loudspeaker of claim 4, wherein the resilient members are fitted about the guiding poles, respectively.

8. The loudspeaker of claim 4, wherein the positioning apparatus further comprises a plurality of connection plates extending rearward from a circumference of the magnetic plate, the connection plates are fitted about the guiding poles, respectively, and the resilient members are resiliently sandwiched between the respective connection plates and the circuit board.

9. The loudspeaker of claim 8, wherein each connection plate comprises an extending portion extending rearward from the magnetic plate and a guiding portion extending from a distal end of the extending portion, each guiding portion defines a guiding hole, the guiding poles are received in the guiding holes, respectively, and the resilient members are sandwiched between the respective guiding portions and the circuit board.

10. The loudspeaker of claim 4, wherein the positioning apparatus further comprises an installation plate extending rearward from the magnetic plate and a positioning ring mounted to the installation plate and positioned away from the magnetic plate, and the positioning ring is engaged in the rotating portion of the connecting member.

11. The loudspeaker of claim 10, wherein the positioning ring comprises a latching portion installed to the installation plate, and an engaging portion engaged with the rotating portion.

12. The loudspeaker of claim 11, wherein the positioning ring is made of pliable plastic.

13. The loudspeaker of claim 1, wherein the rotating portion is spherical.

14. The loudspeaker of claim 1, wherein the connecting member further comprises a mounting portion opposite to the rotating portion, the mounting portion defines an installing hole, a middle of the sound-reflecting member defines a through hole, and a fastening member extends through the through hole and is engaged in the installing hole.

15. The loudspeaker of claim 1, wherein each magnetic piece and the magnetic plate are made of iron.

16. The loudspeaker of claim 1, further comprising a monitoring apparatus electrically coupled to the controller, wherein the monitoring apparatus and the sound-reflecting member point in the same direction, and the monitoring apparatus is configured for capturing images in front of the sound-reflecting member, and for transmitting the images to the controller.

17. The loudspeaker of claim 1, wherein the sound-reflecting member is bowl-shaped, and an inner surface of the sound-reflecting member forms a sound-reflecting surface facing the sound generator.

* * * * *